US009382643B2

(12) United States Patent
Moore et al.

(10) Patent No.: US 9,382,643 B2
(45) Date of Patent: Jul. 5, 2016

(54) APPARATUS, SYSTEM, AND METHOD FOR FORMING NANOFIBERS AND NANOFIBER WEBS

(75) Inventors: Eric M. Moore, Roseville, MN (US); Michael R. Berrigan, Oakdale, MN (US); Daniel J. Zillig, Cottage Grove, MN (US); William P. Klinzing, West Lakeland, MN (US); William J. Kopecky, Hudson, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 904 days.

(21) Appl. No.: 13/390,557

(22) PCT Filed: Aug. 30, 2010

(86) PCT No.: PCT/US2010/047141

§ 371 (c)(1),
(2), (4) Date: Feb. 15, 2012

(87) PCT Pub. No.: WO2011/028661

PCT Pub. Date: Mar. 10, 2011

(65) Prior Publication Data

US 2012/0149273 A1 Jun. 14, 2012

Related U.S. Application Data

(60) Provisional application No. 61/238,761, filed on Sep. 1, 2009.

(51) Int. Cl.

| | |
|---|---|
| ***D04H 1/56*** | (2006.01) |
| ***D01D 4/02*** | (2006.01) |
| ***D04H 3/005*** | (2012.01) |
| ***D04H 3/016*** | (2012.01) |

(Continued)

(52) U.S. Cl.
CPC ..... *D01D 4/025* (2013.01); *D04H 3/005* (2013.01); *D04H 3/016* (2013.01); *D04H 3/147* (2013.01); *D04H 3/16* (2013.01); *Y10T 442/68* (2015.04)

(58) Field of Classification Search
None
See application file for complete search history.

(56) References Cited

U.S. PATENT DOCUMENTS

| | | | |
|---|---|---|---|
| 4,047,861 | A | 9/1977 | Balaz |
| 4,116,656 | A | 9/1978 | Mukai et al. |
| 4,118,531 | A | 10/1978 | Hauser |

(Continued)

FOREIGN PATENT DOCUMENTS

| | | |
|---|---|---|
| CN | 1948563 | 4/2007 |
| JP | 49-6768 B1 | 2/1974 |

(Continued)

*Primary Examiner* — Monica Huson
(74) *Attorney, Agent, or Firm* — James A. Baker

(57) ABSTRACT

A nozzle, die, apparatus, system and method for forming a fiber population having a median diameter less than one micrometer, and nonwoven fibrous webs including a population of such sub-micrometer fibers. The nozzle includes a first conduit having a first terminal end, a second conduit positioned coaxially around the first conduit and having a second terminal end proximate the first terminal end, wherein the first and second conduit form an annular channel between the first and second conduit, and additionally wherein the first terminal end extends axially outwardly beyond the second terminal end. The die includes at least one such nozzle, and the apparatus and system include at least one such die. Methods of making nonwoven fibrous webs including a population of sub-micrometer fibers, and articles including such nonwoven fibrous webs, are also disclosed.

20 Claims, 3 Drawing Sheets

(51) Int. Cl.
*D04H 3/147* (2012.01)
*D04H 3/16* (2006.01)

(56) References Cited

U.S. PATENT DOCUMENTS

| | | | | |
|---|---|---|---|---|
| 4,284,242 | A * | 8/1981 | Randell | F23D 1/005 239/422 |
| 4,536,361 | A | 8/1985 | Torobin | |
| 4,610,760 | A * | 9/1986 | Kirkpatrick et al. | 159/4.01 |
| 4,663,220 | A | 5/1987 | Wisneski et al. | |
| 4,720,252 | A | 1/1988 | Appel et al. | |
| 4,818,464 | A | 4/1989 | Lau | |
| 5,476,616 | A | 12/1995 | Schwarz | |
| 5,496,507 | A | 3/1996 | Angadjivand et al. | |
| 5,533,675 | A | 7/1996 | Benecke et al. | |
| 6,001,303 | A | 12/1999 | Haynes et al. | |
| 6,057,256 | A | 5/2000 | Krueger et al. | |
| 6,074,597 | A | 6/2000 | Kwok et al. | |
| 6,114,017 | A | 9/2000 | Fabbricante et al. | |
| 6,183,670 | B1 | 2/2001 | Torobin et al. | |
| 6,200,120 | B1 * | 3/2001 | Fish et al. | 425/83.1 |
| 6,315,806 | B1 | 11/2001 | Torobin et al. | |
| 6,382,526 | B1 | 5/2002 | Reneker et al. | |
| 6,520,425 | B1 | 2/2003 | Reneker | |
| 6,695,992 | B2 | 2/2004 | Reneker | |
| 6,861,025 | B2 | 3/2005 | Erickson et al. | |
| 6,916,752 | B2 | 7/2005 | Berrigan et al. | |
| 7,267,789 | B2 | 9/2007 | Chhabra et al. | |
| 7,291,300 | B2 | 11/2007 | Chhabra et al. | |
| 7,316,552 | B2 | 1/2008 | Haynes et al. | |
| 7,695,660 | B2 | 4/2010 | Berrigan et al. | |
| 2001/0014358 | A1 | 8/2001 | Fish et al. | |
| 2003/0234464 | A1 | 12/2003 | Erickson et al. | |
| 2006/0141086 | A1 | 6/2006 | Haynes et al. | |
| 2008/0038976 | A1 | 2/2008 | Berrigan et al. | |
| 2008/0093778 | A1 | 4/2008 | Johnson et al. | |
| 2009/0039565 | A1 | 2/2009 | Reneker et al. | |

FOREIGN PATENT DOCUMENTS

| | | |
|---|---|---|
| JP | 61-113809 A | 5/1986 |
| WO | WO 2004/046443 | 6/2004 |
| WO | WO 2007/001990 | 1/2007 |
| WO | WO 2009/085679 | 7/2009 |

* cited by examiner

APPARATUS, SYSTEM, AND METHOD FOR FORMING NANOFIBERS AND NANOFIBER WEBS

CROSS REFERENCE TO RELATED APPLICATION

This application claims the benefit of U.S. Provisional Patent Application No. 61/238,761, filed Sep. 1, 2009, the entire disclosure of which is incorporated by reference herein in its entirety.

TECHNICAL FIELD

The present disclosure relates to a nozzle, die, apparatus, system and method for forming fibers having a median diameter less than one micrometer (μm) and more particularly, nonwoven fibrous webs and articles including a population of such sub-micrometer fibers.

BACKGROUND

Nonwoven fibrous webs have been used to produce absorbent or adsorbent articles useful, for example, as absorbent wipes for surface cleaning, as gas adsorbents and liquid absorbents, as fluid filtration media, and as absorptive barrier materials for use as an acoustic or thermal insulation. In some applications requiring high absorbency, it may be desirable to use a high porosity nonwoven article made up of high surface area sub-micrometer fibers (i.e., nanofibers).

It is known to produce nanofibers by using electrospinning techniques in which spinnable fluid materials are spun into fibers under high electric field conditions. These techniques, however, have been problematic, because flammable organic solvents are generally required to form spinnable fluid materials, some materials (in particular, some polymers) may not be sufficiently soluble in organic solvents to be spinnable, and further, some spinnable fluids are very viscous and require higher forces than electric fields can supply before sparking occurs (i.e., there is a dielectric breakdown in the air). Likewise, these techniques have been problematic where higher temperatures are required because high temperature increases the thermal conductivity and thermal expansion of structural parts and complicates the control of high electrical fields. For this reason, electrospinning has generally not been found suitable for processing polymer melts.

It is also known to use pressurized gas to create polymer fibers from a molten polymer stream using melt-blowing techniques. According to these techniques, a stream of molten polymer is extruded into a jet of gas to form a plurality of fibers that may be collected to form a nonwoven fibrous web. An exemplary apparatus and process for forming a meltblown nonwoven fibrous web is disclosed in U.S. Pat. No. 7,316,552 B2, is illustrated in FIG. 1A, and is instructive in an understanding of the present disclosure.

Referring to FIG. 1A, the melt-blowing system 100 includes a hopper 110 which provides a polymer material to an extruder 112 attached to a die 114 that extends across the width 116 of a nonwoven fibrous web 118 to be formed by the meltblowing process. Gas inlet 120 (and optional gas inlet 122) provides a stream of pressurized gas 127 to die 114. A stream of molten polymer 128 is forced out of slot 138 as a plurality of polymeric fibers 144 through a plurality of small diameter nozzles 148 extending across die 114. The extruded polymeric fibers 144 form a coherent, i.e., cohesive, fibrous nonwoven web 118 on forming surface 146, such as a belt. The fibrous nonwoven web 118 may be removed by rollers

147, which may be designed to bond the polymeric fibers 144 of web 118 through application of heat and/or pressure (e.g., by calendering) to improve the integrity of web 118. Thereafter, web 118 may be transported by a conventional arrangement to a wind-up roll, pattern-embossed, etc. (not shown in FIG. 1A). U.S. Pat. No. 4,663,220 discloses in greater detail an apparatus and process using the above-described elements.

Various apparatus and processes have also been disclosed for use in melt-blowing processes to form a nonwoven fibrous web comprising polymeric fibers wherein at least a portion of the fibers have a mean diameter less than one micrometer (see e.g., U.S. Pat. Nos. 4,047,861; 4,536,361; 4,720,252; 4,818,664; 5,476,616; 5,533,675; 6,074,597; 6,183,670 B1; 6,315,806 B1; 7,291,300 B2; 7,267,789; 7,316,552 B2; U.S. Pat. Application Pub. No. 2008/0093778; and PCT International Pub. No. WO 2007/001990). However, in each instance, the resulting population of polymeric fibers in the nonwoven fibrous web generally exhibits a rather large median diameter, in that the median fiber diameter is generally at least about 1,000 nanometers (1 μm) in diameter and more typically greater than 10 μm in diameter.

Recently, Reneker et al. (U.S. Pat. Nos. 6,382,256 B1; 6,520,425 B1; 6,695,992 B2; and U.S. Pat. Application Pub. No. 2009/0039565 A1) have disclosed various apparatus, nozzles and processes for producing nanofibers. FIG. 1B shows a partial cross-section of an exemplary nozzle 148 of die 114 (FIG. 1A), drawn from FIG. 1 of U.S. Pat. No. 6,382,256 B1. The illustrated nozzle 148 is formed by two concentric cylindrical tubes; inner tube 111 and outer tube 120, which form an annular channel 130. Inner tube 111 defines a channel 126 that receives the stream of pressurized gas 127. Annular column 130 receives the molten polymer stream 128 from extruder 112 (FIG. 1A). Inner tube 111 is positioned such that its end 115 is recessed from the end 114 of outer tube 120, thereby forming a gas jet space 106. In operation, the molten polymer stream 128 passes through annular column 130 and enters the gas jet space 106; the stream of pressurized gas 127 exits the end 115 of inner tube 111. Reneker et al. expressly teaches that the stream of pressurized gas 127 converges with the molten polymer stream 128 in the gas jet space 106 before exiting the nozzle 148, thereby forming a plurality of nanofibers 129.

SUMMARY

This disclosure relates to the production of sub-micrometer fibers from fluids, for example, molten polymers, by forming a molten polymer film and then supplying high pressure blowing air to the interior of the molten polymer film. This process does not rely on any constrained gas jet expansion space after the air interfaces with the molten polymer. The advantage of this method over the prior art is that there are no solid interfaces in the fiber forming space that could potentially interfere with the fiber forming process. This lack of interference prevents globules of molten polymer, or clumps of malformed fibers from sticking to the die body and subsequently dropping as a cohesive mass into the fibrous web product. Such globules or clumps, commonly known as "sand" or "shot," are generally not desired, as they are non-uniform, hard to control through other means, and damage the nonwoven web where they land.

Thus, in one aspect, the disclosure relates to a nozzle for producing a population of sub-micrometer fibers. The nozzle includes a first conduit having a first terminal end, a second conduit positioned coaxially around the first conduit and having a second terminal end proximate the first terminal end, wherein the first and second conduit form an annular channel between the first and second conduit, and additionally wherein the first terminal end extends axially outwardly beyond the second terminal end.

In some exemplary embodiments, at least a portion of the annular channel proximate the first terminal end is directed towards the first conduit. In certain exemplary embodiments, the first terminal end is defined by a generally circular perimeter. In some particular exemplary embodiments, the generally circular perimeter comprises a serrated edge comprising a plurality of teeth creating a saw-toothed pattern around the perimeter. In additional exemplary embodiments, the first terminal end extends axially outward beyond the second terminal end by at least 0.1 mm. In further exemplary embodiments, the first terminal end extends axially outward beyond the second terminal end by at most 5 mm.

In another aspect, the disclosure provides a die comprising at least one nozzle as described above. In some exemplary embodiments, the die comprises a plurality of nozzles as described above. In certain exemplary embodiments, the plurality of said nozzles is arranged in a plurality of rows, such that a fiber stream emitted from any row of nozzles does not substantially overlap in flight with a fiber stream emitted from any other row of nozzles.

In yet another aspect, the disclosure provides an apparatus for forming a nonwoven fibrous web including a population of sub-micrometer fibers, the apparatus including a source of fluent material, a source of pressurized gas, a die incorporating at least one nozzle as described above, wherein the annular channel is connected to the source of fluent material, and the first conduit is connected to the source of pressurized gas, and a collector for collecting the fluent material after exiting the die, wherein the fluent material is collected in substantially solid form as a nonwoven fibrous web on the collector.

In yet a further aspect, the disclosure provides a system for forming a plurality of sub-micrometer fibers, the system including a fluent material stream, a pressurized gas stream, a die incorporating at least one nozzle as described above, wherein the annular channel is connected to the fluent material stream, and the first conduit is connected to the pressurized gas stream, and a collector for collecting said fluent material as a plurality of nonwoven fibers after exiting the die, optionally wherein said plurality of fibers is collected in substantially solid form on the collector as a nonwoven fibrous web. In certain exemplary embodiments, the fluent material stream comprises a molten polymer. In some exemplary embodiments, the pressurized gas stream comprises compressed air.

In an additional aspect, the disclosure provides a method of making a nonwoven fibrous web, including providing a source of fluent material, providing a pressurized gas stream, providing a die incorporating at least one nozzle as described above, placing the annular channel in flow communication with the source of fluent material, placing the first conduit in flow communication with the pressurized gas stream; and collecting the fluent material after exiting the die as a plurality of nonwoven fibers, wherein the plurality of nonwoven fibers is collected in substantially solid form as a nonwoven fibrous web.

In a further aspect, the disclosure provides a method of making a nonwoven fibrous web, including:

a. forming a population of sub-micrometer fibers having a median fiber diameter of less than one micrometer (μm), using a die having at least one nozzle as described above;
b. forming a population of microfibers having a median fiber diameter of at least 1 μm; and
c. combining the population of sub-micrometer fibers and the population of microfibers into a nonwoven fibrous web, wherein at least one of the fiber populations includes substantially molecularly oriented fibers, and further wherein the nonwoven fibrous web has a thickness and exhibits a Solidity of less than 10%.

In an additional aspect, the disclosure relates to an article made from a nonwoven fibrous web including a population of sub-micrometer fibers prepared according to the method as described above. In exemplary embodiments, the article is selected from a gas filtration article, a liquid filtration article, a sound absorption article, a surface cleaning article, a cellular growth support article, a drug delivery article, a personal hygiene article, and a wound dressing article.

Exemplary embodiments according to the present disclosure may have certain surprising and unexpected advantages over the art. For example, in some exemplary embodiments, the nozzle as disclosed herein eliminates the need for a defined gas jet space as expressly taught by Reneker et al., by allowing the sub-micrometer fibers to form in the ambient air space directly outside of the nozzle body, instead of within the outer tube of the nozzle body. One advantage of this configuration may be to limit or eliminate the possibility of newly formed fibers contacting any die surface. If the newly formed fibers were to contact the die, they could re-melt and stick to the die face. These re-melted fibers could then form globules or clumps (i.e., "sand" or "shot") which can fall onto the nonwoven web and damage the web where they land.

In other exemplary embodiments, the nozzle, die, apparatus, system and method of the present disclosure may permit production of nonwoven fibrous webs containing a relatively higher proportion of sub-micrometer fibers relative to the amount of microfibers. Other exemplary embodiments of the present disclosure may have structural features that enable their use in a variety of applications; may have exceptional absorbent and/or adsorbent properties; may exhibit high porosity, high fluid permeability, and/or low pressure drop when used as a fluid filtration medium due to their low Solidity; and may be manufactured in a cost-effective and efficient manner.

Various aspects and advantages of exemplary embodiments of the present invention have been summarized. The above Summary is not intended to describe each illustrated embodiment or every implementation of the present invention. The Drawings and the Detailed Description that follow more particularly exemplify certain preferred embodiments using the principles disclosed herein.

BRIEF DESCRIPTION OF THE DRAWINGS

Exemplary embodiments of the present disclosure are further described with reference to the appended figures, wherein.

DETAILED DESCRIPTION

Glossary

Figure 1A:
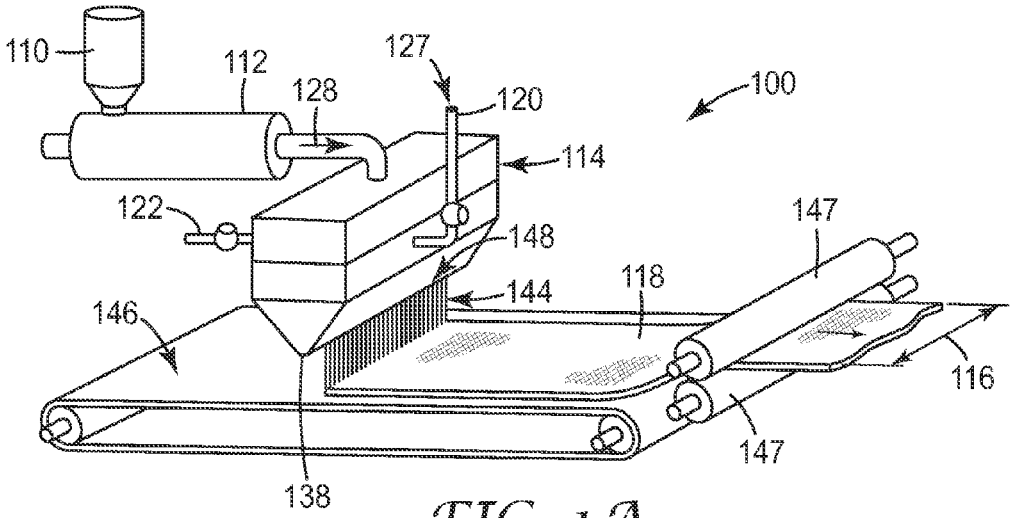
FIG. 1A Prior Art
FIG. 1A is a schematic representation of an exemplary prior art melt-blowing apparatus.

As used herein:

"Microfibers" are a population of fibers having a population median diameter of at least one micrometer.

"Ultrafine microfibers" are a population of microfibers having a population median diameter of two micrometers or less.

"Sub-micrometer fibers" (also referred to as "nanofibers") are a population of fibers having a population median diameter of less than one micrometer.

When reference is made herein to a batch, group, array, etc. of a particular kind of microfiber, e.g., "an array of sub-micrometer fibers," it means the complete population of microfibers in that array, or the complete population of a single batch of microfibers, and not only that portion of the array or batch that is of sub-micrometer dimensions.

"Continuous oriented microfibers" herein refers to essentially continuous fibers issuing from a die and traveling through a processing station in which the fibers are drawn and at least portions of the molecules within the fibers are oriented into alignment with the longitudinal axis of the fibers ("oriented" as used with respect to fibers means that at least portions of the molecules of the fibers are aligned along the longitudinal axis of the fibers).

"Melt-blown fibers" herein refers to fibers prepared by extruding molten fiber-forming material through orifices or nozzles in a die into a high-velocity gaseous stream, where the extruded material is first attenuated and then solidifies as a mass of fibers.

"Separately prepared sub-micrometer fibers" means a stream of sub-micrometer fibers produced from a sub-micrometer fiber-forming apparatus (e.g., a die) positioned such that the sub-micrometer fiber stream is initially spatially separate (e.g., over a distance of about 1 inch (25 mm) or more from, but will merge in flight and disperse into, a stream of larger size microfibers.

"Autogenous bonding" is defined as bonding between fibers at an elevated temperature as obtained in an oven or with a through-air bonder without application of direct contact pressure such as in point-bonding or calendering.

"Molecularly same" polymer refers to polymers that have essentially the same repeating molecular unit, but which may differ in molecular weight, method of manufacture, commercial form, etc.

"Self supporting" or "self sustaining" in describing a web means that the web can be held, handled and processed by itself.

"Solidity" is a nonwoven web property inversely related to density and characteristic of web permeability and porosity (low Solidity corresponds to high permeability and high porosity), and is defined by the equation:

$$\text{Solidity (\%)} = \frac{[3.937 * \text{Web Basis Weight (g/m}^2)]}{[\text{Web Thickness (mils)} * \text{Bulk Density (g/cm}^3)]}$$

"Web Basis Weight" is calculated from the weight of a 10 cm×10 cm web sample.

"Web Thickness" is measured on a 10 cm×10 cm web sample using a thickness testing gauge having a tester foot with dimensions of 5 cm×12.5 cm at an applied pressure of 150 Pa.

"Bulk Density" is the bulk density of the polymer or polymer blend that makes up the web, taken from the literature.

Figure 2:
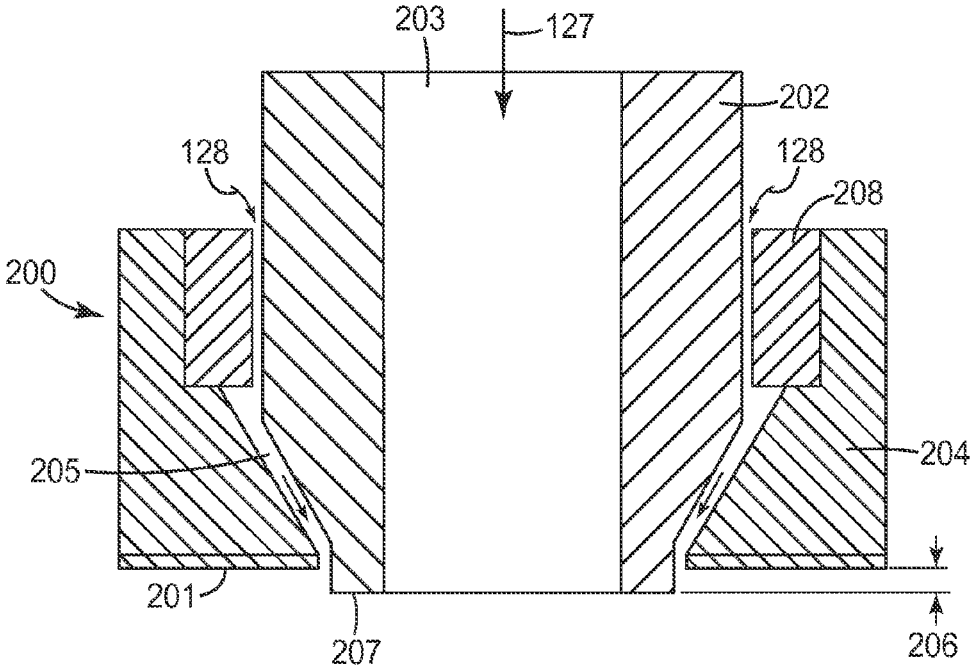
FIG. 2 is a partial cross-sectional view of an exemplary nozzle for use in a melt-blowing die, process and method according to the present disclosure.

Various exemplary embodiments of the disclosure will now be described with particular reference to the Drawings. Exemplary embodiments of the present invention may take on various modifications and alterations without departing from the spirit and scope of the disclosure. Accordingly, it is to be understood that the embodiments of the present invention are not to be limited to the following described exemplary embodiments, but is to be controlled by the limitations set forth in the claims and any equivalents thereof A. Fiber-forming Nozzle and Die In one aspect, the disclosure relates to a nozzle for producing a population of sub-micrometer fibers. As shown in FIG. 2, in exemplary embodiments, the nozzle 200 includes a first conduit 202 having an internal channel 203 and a first terminal end 207, a second conduit 204 positioned coaxially around the first conduit 202 and having a second terminal end 201 proximate the first terminal end 207, wherein the first 202 and second 204 conduit form an annular channel 205 between the first and second conduit, and additionally wherein the first terminal end 207 extends axially outwardly beyond the second terminal end 201. In operation, the annular channel 205 is connected to a fluent material stream 128 obtained from a source of fluent material (not shown in FIG. 2), and the first conduit 202 is connected to a pressurized gas stream 127 obtained from a source of pressurized gas (not shown in FIG. 2).

As shown in FIG. 2, the second terminal end 201 is recessed from the first terminal end 207 by a distance 206. In this manner, no gas jet space as defined by Reneker et al. is formed within second conduit 204 or the nozzle 200. In some exemplary embodiments, an optional nit liner 208 may be positioned between at least a portion of first conduit 202 and second conduit 204. The nit liner 208 acts as a bushing or separating ring to center the first conduit 202 coaxially within the second conduit 204, if desired. The nit liner 208 may be selected to have an axial thickness which permits axial adjustment of the positions of first conduit 202 relative to second conduit 204. In this manner, the distance 206 between the first terminal end 207 and second terminal end 201 may be freely adjusted. However, in such embodiments, the nit liner 208 axial thickness is selected so that the first terminal end 207 extends axially outwardly beyond the second terminal end 201, as shown in FIG. 2. In this manner, formation of a gas jet space within the body of the nozzle 200 is avoided.

Thus in exemplary embodiments, the nozzle 200 eliminates the need for a defined gas jet space as expressly taught by Reneker et al., by allowing the sub-micrometer fibers to form in the ambient air space directly outside of the nozzle body, instead of within the outer tube of the nozzle body. One advantage of this configuration may be to limit or eliminate the possibility of newly formed fibers contacting any die surface. If the newly formed fibers were to contact the die, they could re-melt and stick to the die face. These re-melted fibers could then form globules or clumps (i.e. "sand" or "shot") which can fall onto the nonwoven web and damage the web where they land.

In an exemplary presently preferred embodiment illustrated by FIG. 2, at least a portion of the annular channel 205 proximate the first terminal end 207 is angled in towards the center axis of first conduit 202. In certain exemplary embodiments (not shown in the drawings), the first and second conduits have a generally cylindrical or tubular shape; in other words, in some exemplary embodiments, the first and second conduits have a generally circular cross-section taken in a direction perpendicular to the axial direction of the nozzle. In certain presently preferred embodiments (not shown in the drawings), the first and second conduits have a generally circular cross-section taken in a direction perpendicular to the axial direction of the nozzle, and the second conduit is positioned concentrically around the first conduit.

Figure 3:
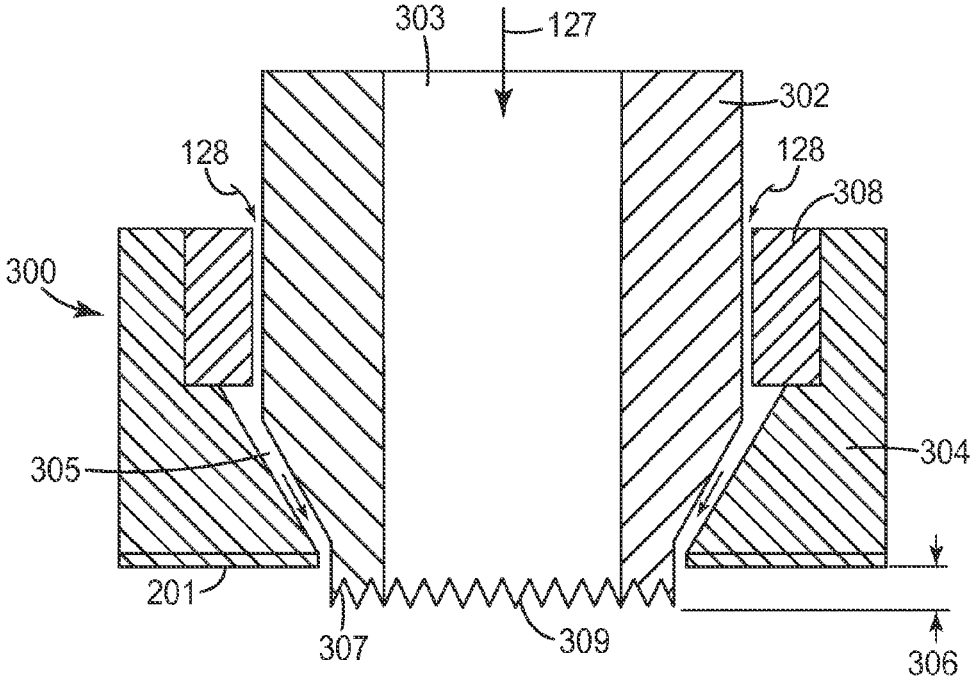
FIG. 3 is a partial cross-sectional view of an exemplary nozzle for use in a melt-blowing die, process and method according to the present disclosure.

In additional exemplary embodiments illustrated by FIG. 3, a nozzle 300 includes a first conduit 302 having a first terminal end 307, a second conduit 304 positioned coaxially around the first conduit 302 and having a second terminal end 201 proximate the first terminal end 307, wherein the first 302 and second 304 conduit form an annular channel 305 between the first and second conduit, wherein the first terminal end 307 extends axially outwardly beyond the second terminal end 301, and additionally wherein the first terminal end is defined by a generally circular perimeter which encompasses a profiled tip, which may be regular, for example generally circular as shown in FIG. 2, or irregular, for example a saw-toothed pattern 309 as shown in FIG. 3. Thus in some exemplary embodiments, the generally circular perimeter comprises a serrated edge comprising a plurality of teeth creating a saw-toothed pattern around the perimeter As shown in FIG. 3, the second terminal end 201 is recessed from the first terminal end 307 by a distance 306. In this manner, no gas jet space as defined by Reneker et al. is formed within second conduit 304 or the nozzle 300. In some exemplary embodiments, an optional nit liner 308 may be positioned between at least a portion of first conduit 302 and second conduit 304. The nit liner 308 may be selected to have an axial thickness which permits axial adjustment of the positions of first conduit 302 relative to second conduit 304. In this manner, the distance 306 between the first terminal end 307 and second terminal end 201 may be freely adjusted. However, in such embodiments, the nit liner 308 axial thickness is selected so that the first terminal end 307 extends axially outwardly beyond the second terminal end 201, as shown in FIG. 2. In this manner, formation of a gas jet space within the body of the nozzle 300 is avoided.

In an exemplary presently preferred embodiment illustrated by FIG. 3, at least a portion of the annular channel 305 proximate the first terminal end 307 is directed towards the first conduit 302. In certain exemplary embodiments (not shown in the drawings), the first and second conduits have a generally cylindrical or tubular shape; in other words, in some exemplary embodiments, the first and second conduits have a generally circular cross-section taken in a direction perpendicular to the axial direction of the nozzle. In certain presently preferred embodiments (not shown in the drawings), the first and second conduits have a generally circular cross-section taken in a direction perpendicular to the axial direction of the nozzle, and the second conduit is positioned concentrically around the first conduit.

In some exemplary embodiments of the above-referenced nozzles, the first terminal end extends axially outward beyond the second terminal end by at least 0.1 mm, at least 0.2 mm, at least 0.3 mm mm, at least 0.4 mm, at least 0.5 mm, or at least 1 mm. In further exemplary embodiments, the first terminal end extends axially outward beyond the second terminal end by at most 5 mm, at most 4 mm, at most 3 mm, at most 2 mm, or at most 1 mm.

In another aspect, the disclosure provides a die comprising at least one nozzle as described above. In some exemplary embodiments, the die comprises a plurality of nozzles as described above. In certain exemplary embodiments, the plurality of nozzles is arranged in at least one row.

B. Apparatus and System for Forming Nonwoven Fibrous Webs

In yet another aspect, the disclosure provides, in additional exemplary embodiments, an apparatus for forming a nonwoven fibrous web, the apparatus including a source of fluent material, a source of pressurized gas, a die incorporating at least one nozzle installed in a die as described above, wherein the annular channel is connected to the source of fluent material, and the first conduit is connected to the source of pressurized gas, and a collector for collecting the fluent material after exiting the die, wherein the fluent material is collected in substantially solid form as a nonwoven fibrous web on the collector.

Figure 4:
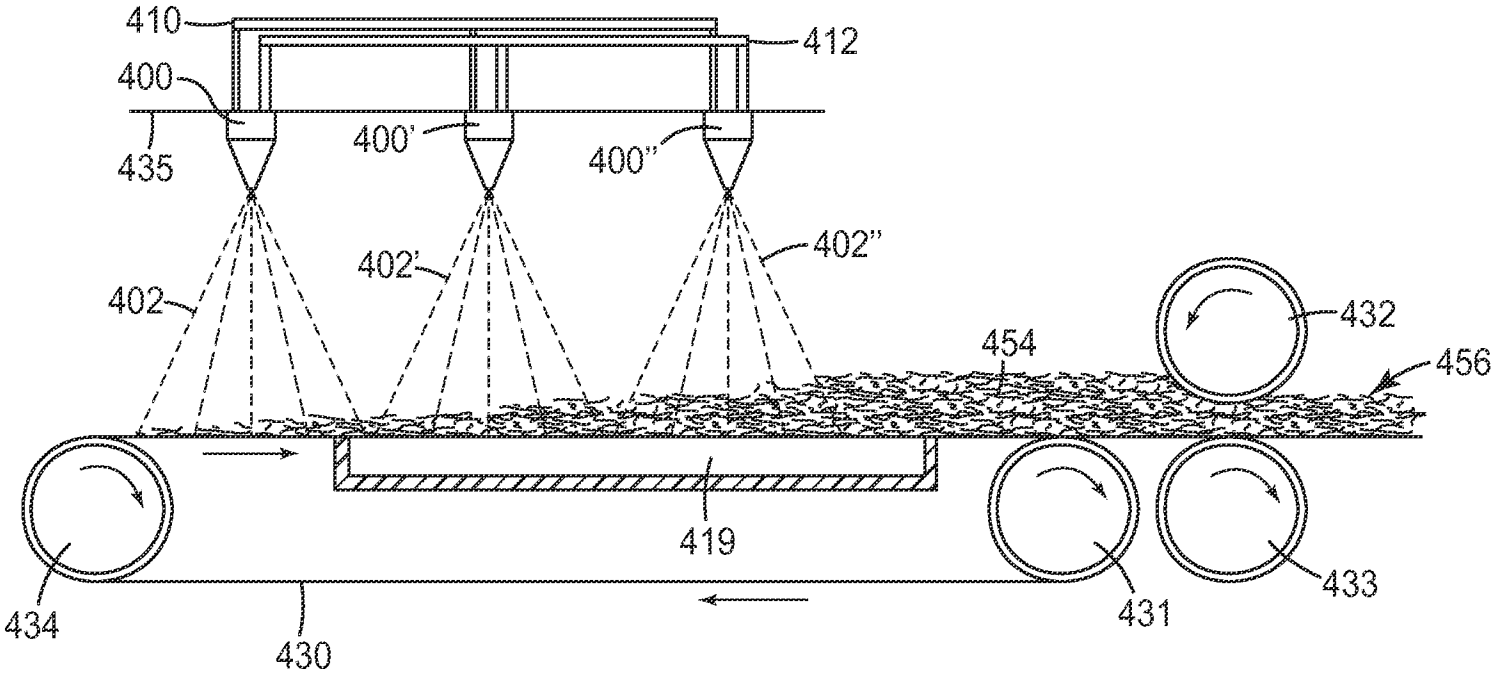
FIG. 4 is a schematic representation of an exemplary apparatus, system and process for forming nonwoven fibrous webs including sub-micrometer fibers according to the present disclosure.

As generally illustrated in FIG. 4, the apparatus includes a die 435 including at least one nozzle 400, a source of fluent material 410, and a source of pressurized gas 412. The annular channel of the die 435 is connected to the source of fluent material, and the first conduit is connected to the source of pressurized gas 412. As shown by phantom lines in FIG. 4, a stream 402 of continuous sub-micrometer fibers is emitted from nozzle 400 of die 435 and directed toward collection apparatus 456, where the fibers are collected to form a nonwoven fibrous web 454.

The collection apparatus 456 is illustrated as an endless belt 430 running between rollers 431 and 434; however, other collection apparatus known in the art may be used, as described below. An optional vacuum box 419 may be positioned under a portion of the endless belt 430 as shown in FIG. 4, in order to assist collection and consolidation of the collected nonwoven fibrous web 454 formed by collection of the sub-micrometer fiber stream 402. Optional post processing of the collected web 454 may also be carried out, for example, consolidation of the collected nonwoven fibrous web 454 by application of heat and/or pressure (e.g., calendering), as illustrated by rollers 432 and 433 in FIG. 4. Other post processing techniques may be applied to the collected nonwoven fibrous web including a plurality of sub-micrometer fibers, as described further below.

Exemplary embodiments of the present disclosure may be practiced by collecting the nonwoven fibrous web including a plurality of sub-micrometer fibers on a continuous screen-type collector such as the belt-type collector 456 as shown in FIG. 4, on a screen-covered drum (not shown), or using alternative methods known in the art. In one exemplary alternative collection method, a web can be collected by aiming the merged stream of microfibers and sub-micrometer fibers into the gap between two collectors, as shown and described in Olson et al., PCT International Pub. No. WO 2004/046443, whereupon a web having a C-shaped configuration of fibers may be obtained.

In some exemplary embodiments, one or more additional nozzles 400' and 400" as described above, may be used in the apparatus such that the annular channel of each die is connected to the source of fluent material 410, and the first conduit of each die is connected to the source of pressurized gas 412. As shown in phantom lines in FIG. 4, an optional second sub-micrometer fiber stream 402', third sub-micrometer fiber stream 402", or any number of additional streams of sub-micrometer fibers may be formed. Preferably, the nozzles are positioned such that no overlap occurs between sub-micrometer fiber streams (e.g. 402, 402' and 402") while the fibers remain in flight (i.e., before collection of the plurality of sub-micrometer fibers as a fibrous nonwoven web 454 on collector 456.

The fiber-forming apparatus shown in FIG. 4 is one exemplary apparatus for use in practicing certain embodiments of the present disclosure. Sub-micrometer fiber-forming die 435 may be used to form sub-micrometer fibers either alone or in combination with additional dies for forming sub-micrometer fibers and/or microfibers. Such dies are known in the art. Suitable apparatus, dies and methods of combining sub-micrometer fibers with microfibers in a nonwoven fibrous web are disclosed PCT International Pub. No. WO2009/085679.

In yet a further aspect, the disclosure provides a system for forming a plurality of sub-micrometer fibers, the system including a fluent material stream, a pressurized gas stream, a die incorporating at least one nozzle as described above, wherein the annular channel is connected to the fluent material stream, and the first tube is connected to the pressurized gas stream, and a collector for collecting said fluent material as a plurality of nonwoven fibers after exiting the die, wherein said plurality of fibers is collected in substantially solid form on the collector as a nonwoven fibrous web. In certain exemplary embodiments, the fluent material stream comprises a molten polymer. In some exemplary embodiments, the pressurized gas stream comprises compressed air.

Various processes conventionally used as adjuncts to fiber-forming processes may be used in connection with filaments as they enter or exit from the optional attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

Sub-micrometer fibers are typically very long, though they are generally regarded as discontinuous. Their long lengths—with a length-to-diameter ratio approaching infinity in contrast to the finite lengths of staple fibers—causes them to be better held within the matrix of microfibers. They are usually organic and polymeric and often of the molecularly same polymer as the microfibers. As the streams of sub-micrometer fiber and microfibers merge, the sub-micrometer fibers become dispersed among the microfibers. A rather uniform mixture may be obtained, especially in the x-y dimensions, with the distribution in the axial direction being controlled by particular process steps such as control of the distance between the merging streams, the angle between the merging streams, and the mass and velocity of the merging streams, as is known in the art (see e.g., U.S. Pat. Nos. 6,916,752 and 7,695,660). The merged stream continues to the collector, and there is collected as a web-like nonwoven fibrous web.

The relative amount of sub-micrometer fibers to microfibers included in a nonwoven composite fibrous web of the present disclosure can be varied depending on the intended use of the web. An effective amount, i.e., an amount effective to accomplish desired performance, need not be large in weight amount. Usually the microfibers account for at least one weight percent and no more than 100 weight percent of the fibers of the web. Because of the high surface area of the microfibers, a small weight amount may accomplish desired performance. In the case of webs that include very small microfibers, the microfibers generally account for at least 5 percent of the fibrous surface area of the web, and more typically 10 or 20 percent or more of the fibrous surface area. A particular advantage of exemplary embodiments of the present invention is the ability to present small-diameter fibers to a needed application such as filtration or thermal or acoustic insulation.

Depending on the condition of the microfibers and sub-micrometer fibers, some bonding may occur between the fibers during collection. However, further bonding between the microfibers in the collected web is usually needed to provide a matrix of desired coherency, making the web more handleable and better able to hold the sub-micrometer fibers within the matrix ("bonding" fibers means adhering the fibers together firmly, so they generally do not separate when the web is subjected to normal handling).

Conventional bonding techniques using heat and pressure applied in a point-bonding process or by smooth calendar rolls can be used, though such processes may cause undesired deformation of fibers or compaction of the web. A more preferred technique for bonding the microfibers is taught in U.S. Pat. Application Pub. No. 2008/0038976 A1. Apparatus and methods for performing this presently preferred bonding technique is illustrated in FIGS. 1, 5 and 6 of the drawings in U.S. Pat. Application Pub. No. 2008/0038976 A1.

In brief summary, as applied to the present disclosure, this preferred technique involves subjecting the collected web of microfibers and sub-micrometer fibers to a controlled heating and quenching operation that includes a) forcefully passing through the web a gaseous stream heated to a temperature sufficient to soften the microfibers sufficiently to cause the microfibers to bond together at points of fiber intersection (e.g., at sufficient points of intersection to form a coherent or bonded matrix), the heated stream being applied for a discrete time too short to wholly melt the fibers, and b) immediately forcefully passing through the web a gaseous stream at a temperature at least 50° C. less than the heated stream to quench the fibers (as defined in the above-mentioned U.S. Pat. Application Pub. No. 2008/0038976 A1, "forcefully" means that a force in addition to normal room pressure is applied to the gaseous stream to propel the stream through the web; "immediately" means as part of the same operation, i.e., without an intervening time of storage as occurs when a web is wound into a roll before the next processing step). As a shorthand term this technique is described as the quenched flow heating technique, and the apparatus as a quenched flow heater.

It has been found that the sub-micrometer fibers do not substantially melt or lose their fiber structure during the bonding operation, but remain as discrete microfibers with their original fiber dimensions. Without wishing to be bound by any particular theory, Applicant's believe that sub-micrometer fibers have a different, less crystalline morphology than microfibers, and we theorize that the limited heat applied to the web during the bonding operation is exhausted in developing crystalline growth within the sub-micrometer fibers before melting of the sub-micrometer fibers occurs. Whether this theory is correct or not, bonding of the microfibers without substantial melting or distortion of the sub-micrometer fibers does occur and may be beneficial to the properties of the finished web.

A variation of the described method, taught in more detail in the aforementioned U.S. Pat. Application Pub. No. 2008/0038976 A1, takes advantage of the presence of two different kinds of molecular phases within microfibers—one kind called crystallite-characterized molecular phases because of a relatively large presence of chain-extended, or strain-induced, crystalline domains, and a second kind called amorphous-characterized phases because of a relatively large presence of domains of lower crystalline order (i.e., not chain-extended) and domains that are amorphous, though the latter may have some order or orientation of a degree insufficient for crystallinity. These two different kinds of phases, which need not have sharp boundaries and can exist in mixture with one another, have different kinds of properties, including different melting and/or softening characteristics: the first phase characterized by a larger presence of chain-extended crystalline domains melts at a temperature (e.g., the melting point of the chain-extended crystalline domain) that is higher than the temperature at which the second phase melts or softens (e.g., the glass transition temperature of the amorphous domain as modified by the melting points of the lower-order crystalline domains).

In the stated variation of the described method, heating is at a temperature and for a time sufficient for the amorphous-characterized phase of the fibers to melt or soften while the crystallite-characterized phase remains unmelted. Generally, the heated gaseous stream is at a temperature greater than the onset melting temperature of the polymeric material of the fibers. Following heating, the web is rapidly quenched as discussed above.

Treatment of the collected web at such a temperature is found to cause the microfibers to become morphologically refined, which is understood as follows (we do not wish to be bound by statements herein of our "understanding," which generally involve some theoretical considerations). As to the amorphous-characterized phase, the amount of molecular material of the phase susceptible to undesirable (softening-impeding) crystal growth is not as great as it was before treatment. The amorphous-characterized phase is understood to have experienced a kind of cleansing or reduction of molecular structure that would lead to undesirable increases in crystallinity in conventional untreated fibers during a thermal bonding operation. Treated fibers of certain exemplary embodiments of the present invention may be capable of a kind of "repeatable softening," meaning that the fibers, and particularly the amorphous-characterized phase of the fibers, will undergo to some degree a repeated cycle of softening and resolidifying as the fibers are exposed to a cycle of raised and lowered temperature within a temperature region lower than that which would cause melting of the whole fiber.

In practical terms, repeatable softening is indicated when a treated web (which already generally exhibits a useful bonding as a result of the heating and quenching treatment) can be heated to cause further autogenous bonding of the fibers. The cycling of softening and resolidifying may not continue indefinitely, but it is generally sufficient that the fibers may be initially bonded by exposure to heat, e.g., during a heat treatment according to certain exemplary embodiments of the present invention, and later heated again to cause re-softening and further bonding, or, if desired, other operations, such as calendering or re-shaping. For example, a web may be calendered to a smooth surface or given a nonplanar shape, e.g., molded into a face mask, taking advantage of the improved bonding capability of the fibers (though in such cases the bonding is not limited to autogenous bonding).

While the amorphous-characterized, or bonding, phase has the described softening role during web-bonding, calendering, shaping or other like operation, the crystallite-characterized phase of the fiber also may have an important role, namely to reinforce the basic fiber structure of the fibers. The crystallite-characterized phase generally can remain unmelted during a bonding or like operation because its melting point is higher than the melting/softening point of the amorphous-characterized phase, and it thus remains as an intact matrix that extends throughout the fiber and supports the fiber structure and fiber dimensions.

Thus, although heating the web in an autogenous bonding operation may cause fibers to weld together by undergoing some flow and coalescence at points of fiber intersection, the basic discrete fiber structure is substantially retained over the length of the fibers between intersections and bonds; preferably, the cross-section of the fibers remains unchanged over the length of the fibers between intersections or bonds formed during the operation. Similarly, although calendering of a web may cause fibers to be reconfigured by the pressure and heat of the calendering operation (thereby causing the fibers to permanently retain the shape pressed upon them during calendering and make the web more uniform in thickness), the fibers generally remain as discrete fibers with a consequent retention of desired web porosity, filtration, and insulating properties.

An advantage of certain exemplary embodiments of the present invention may be that the sub-micrometer fibers held within a microfiber web may be better protected against compaction than they would be if present in an all-sub-micrometer fiber layer. The microfibers are generally larger, stiffer and stronger than the sub-micrometer fibers, and they can be made from material different from that of the microfibers. The presence of the microfibers between the sub-micrometer fibers and an object applying pressure may limit the application of crushing force on the sub-micrometer fibers. Especially in the case of sub-micrometer fibers, which can be quite fragile, the increased resistance against compaction or crushing that may be provided by certain exemplary embodiments of the present invention offers an important benefit. Even when webs according to the present disclosure are subjected to pressure, e.g., by being rolled up in jumbo storage rolls or in secondary processing, webs of the present disclosure may offer good resistance to compaction of the web, which could otherwise lead to increased pressure drop and poor loading performance for filters. The presence of the microfibers also may add other properties such as web strength, stiffness and handling properties.

The diameters of the fibers can be tailored to provide needed filtration, acoustic absorption, and other properties. For example it may be desirable for the microfibers to have a median diameter of 5 to 50 micrometers (μm) and the sub-micrometer fibers to have a median diameter from 0.1 μm to less than 1 μm, for example, 0.9 μm. Preferably the microfibers have a median diameter between 5 μm and 50 μm, whereas the sub-micrometer fibers preferably have a median diameter of 0.5 μm to less than 1 μm, for example, 0.9 μm.

As previously stated, certain exemplary embodiments of the present invention may be particularly useful to combine very small microfibers, for example ultrafine microfibers having a median diameter of from 1 μm to about 2 μm, with the sub-micrometer fibers. Also, as discussed above, it may be desirable to form a gradient through the web, e.g., in the relative proportion of sub-micrometer fibers to microfibers over the thickness of the web, which may be achieved by varying process conditions such as the air velocity or mass rate of the sub-micrometer fiber stream or the geometry of the intersection of the microfiber and sub-micrometer fiber streams, including the distance of the die from the microfiber stream and the angle of the sub-micrometer fiber stream. A higher concentration of sub-micrometer fibers near one edge or surface of a nonwoven fibrous web according to the present disclosure may be particularly advantageous for gas and/or liquid filtration applications.

In preparing microfibers or sub-micrometer fibers according to various embodiments of the present disclosure, different fiber-forming materials may be extruded through different orifices of a meltspinning extrusion head or meltblowing die so as to prepare webs that comprise a mixture of fibers. Various procedures are also available for electrically charging a nonwoven fibrous web to enhance its filtration capacity; see e.g., Angadjivand, U.S. Pat. No. 5,496,507.

In some exemplary embodiments, webs prepared from sub-micrometer fibers themselves may be undesirably flimsy and weak. However, in certain exemplary embodiments, by incorporating a population of sub-micrometer fibers with a population of microfibers in a coherent, bonded, oriented composite fibrous structure, a strong and self-supporting web or sheet material can be obtained, either with or without an optional support layer.

In addition to the foregoing methods of making a nonwoven fibrous web, one or more of the following process steps may be carried out on the web once formed:

(1) advancing the nonwoven fibrous web along a process pathway toward further processing operations;

(2) bringing one or more additional layers into contact with an outer surface of the sub-micrometer fiber component, the microfiber component, and/or the optional support layer;

(3) calendering the nonwoven fibrous web;

(4) coating the nonwoven fibrous web with a surface treatment or other composition (e.g., a fire retardant composition, an adhesive composition, or a print layer);

(5) attaching the nonwoven fibrous web to a cardboard or plastic tube;

(6) winding-up the nonwoven fibrous web in the form of a roll;

(7) slitting the nonwoven fibrous web to form two or more slit rolls and/or a plurality of slit sheets;

(8) placing the nonwoven fibrous web in a mold and molding the nonwoven fibrous web into a new shape;

(9) applying a release liner over an exposed optional pressure-sensitive adhesive layer, when present; and

(10) attaching the nonwoven fibrous web to another substrate via an adhesive or any other attachment device including, but not limited to, clips, brackets, bolts/screws, nails, and straps.

C. Methods of Making Nonwoven Fibrous Webs

The present disclosure is also directed to methods of making the nonwoven fibrous webs. Thus, in another aspect, the disclosure provides a method of making a nonwoven fibrous web, including:

a. forming a population of sub-micrometer fibers having a median fiber diameter of less than one micrometer (μm), using a die having at least one nozzle as described above;
b. forming a population of microfibers having a median fiber diameter of at least 1 μm; and
c. combining the population of sub-micrometer fibers and the population of microfibers into a nonwoven fibrous web, wherein at least one of the fiber populations includes substantially oriented fibers, and further wherein the nonwoven fibrous web has a thickness and exhibits a Solidity of less than 10%.

In some exemplary embodiments, combining the population of sub-micrometer fibers and the population of microfibers into a nonwoven fibrous web preferably takes place as the sub-micrometer fibers and microfibers are collected on the collector.

1. Formation of Sub-micrometer Fibers (Nanofibers)

Figure 1B:
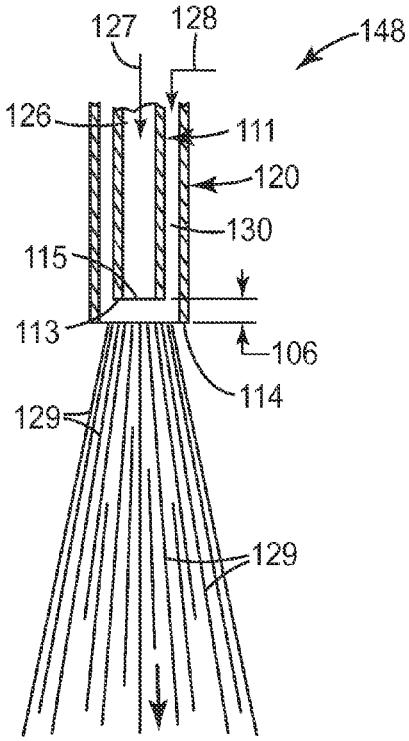
FIG. 1B Prior Art
FIG. 1B is a partial cross-sectional side view of an exemplary prior art nozzle for use in a melt-blowing die.

The process used for forming a population of sub-micrometer fibers and depositing the population of sub-micrometer fibers as a nonwoven fibrous web according to embodiments of the present disclosure, is generally described as a melt-blowing process, such as that illustrated in FIG. 1A and disclosed in U.S. Pat. No. 7,316,552 B2. The present process, apparatus and method are distinguished from a conventional melt blowing process, however, by the nature of the die and nozzle configuration used to form the fibers. The method includes providing a source of fluent material, providing a pressurized gas stream, providing a die incorporating at least one extended nozzle as disclosed herein (see, for example, FIGS. 2-3), placing the annular channel in flow communication with the source of fluent material, placing the first tube in flow communication with the pressurized gas stream, and collecting the fluent material after exiting the die as a plurality of nonwoven fibers, wherein the plurality of nonwoven fibers is collected in substantially solid form as a nonwoven fibrous web.

2. Formation of Optional Microfibers

A number of processes may be used to produce and deposit the population of microfibers, including, but not limited to, melt blowing, melt spinning, filament extrusion, plexifilament formation, spunbonding, wet spinning, dry spinning, or a combination thereof. Suitable processes for forming microfibers are described in U.S. Pat. Nos. 6,315,806 (Torobin); U.S. Pat No. 6,114,017 (Fabbricante et al.); U.S. Pat No. 6,382,526 B1 (Reneker et al.); and U.S. Pat No. 6,861,025 B2 (Erickson et al.). Alternatively, a population of microfibers may be formed or converted to staple fibers and combined with a population of sub-micrometer fibers using, for example, using a process as described in U.S. Pat. No. 4,118,531 (Hauser). In certain exemplary embodiments, the population of microfibers comprises a web of bonded microfibers, wherein bonding is achieved using thermal bonding, adhesive bonding, powdered binder, hydroentangling, needlepunching, calendering, or a combination thereof, as described below.

Processes that are capable of producing oriented fibers include: oriented film filament formation, melt-spinning, plexifilament formation, spunbonding, wet spinning, and dry spinning. Suitable processes for producing oriented fibers are also known in the art (see, for example, Ziabicki, Andrzej, *Fundamentals of Fibre Formation: The Science of Fibre Spinning and Drawing*, Wiley, London, 1976.). Orientation does not need to be imparted within a fiber during initial fiber formation, and may be imparted after fiber formation, most commonly using drawing or stretching processes.

In some exemplary embodiments, a nonwoven fibrous web may be formed of sub-micrometer fibers commingled with coarser microfibers providing a support structure for the sub-micrometer nonwoven fibers. The support structure may provide the resiliency and strength to hold the fine sub-micrometer fibers in the preferred low Solidity form. The support structure could be made from a number of different components, either singly or in concert. Examples of supporting components include, for example, microfibers, discontinuous oriented fibers, natural fibers, foamed porous cellular materials, and continuous or discontinuous non oriented fibers.

In one exemplary embodiment, a microfiber stream is formed and a sub-micrometer fiber stream is separately formed and added to the microfiber stream to form the nonwoven fibrous web. In another exemplary embodiment, a sub-micrometer fiber stream is formed and a microfiber stream is separately formed and added to the sub-micrometer fiber stream to form the nonwoven fibrous web. In these exemplary embodiments, either one or both of the sub-micrometer fiber stream and the microfiber stream is oriented. In an additional embodiment, an oriented sub-micrometer fiber stream is formed and discontinuous microfibers are added to the sub-micrometer fiber stream, e.g., using a process as described in U.S. Pat. No. 4,118,531 (Hauser).

In some exemplary embodiments, the method of making a nonwoven fibrous web comprises combining the sub-micrometer fiber population and the microfiber population into a nonwoven fibrous web by mixing fiber streams, hydroentangling, wet forming, plexifilament formation, needle punching, or a combination thereof. In combining the sub-micrometer fiber population with the microfiber population, multiple streams of one or both types of fibers may be used, and the streams may be combined in any order. In this manner, nonwoven composite fibrous webs may be formed exhibiting various desired concentration gradients and/or layered structures.

For example, in certain exemplary embodiments, the population of sub-micrometer fibers may be combined with the population of microfibers to form an inhomogenous mixture of fibers. In other exemplary embodiments, the population of sub-micrometer fibers may be formed as an overlayer on an underlayer comprising the population of microfibers. In certain other exemplary embodiments, the population of microfibers may be formed as an overlayer on an underlayer comprising the population of sub-micrometer fibers In other exemplary embodiments, the composite nonwoven fibrous article may be formed by depositing the population of sub-micrometer fibers onto a support layer, the support layer optionally comprising microfibers, so as to form a population of sub-micrometer fibers on the support layer or substrate. The method may comprise a step wherein the support layer, which optionally comprises polymeric microfibers, is passed through a fiber stream of sub-micrometer fibers having a median fiber diameter of less than 1 micrometer (μm). While passing through the fiber stream, sub-micrometer fibers may be deposited onto the support layer so as to be temporarily or permanently bonded to the support layer. When the fibers are deposited onto the support layer, the fibers may optionally bond to one another, and may further harden while on the support layer.

In certain presently preferred embodiments, the sub-micrometer fiber population is combined with an optional support layer that comprises at least a portion of the microfiber population. In other presently preferred embodiments, the sub-micrometer fiber population is combined with an optional support layer and subsequently combined with at least a portion of the microfiber population.

D. Nonwoven Fibrous Web Components

In one aspect, the disclosure relates to a nonwoven fibrous web including a population of sub-micrometer fibers having a median diameter less than one micrometer (μm), and optionally a population of microfibers having a median diameter of at least 1 μm. In certain embodiments, at least one of the fiber populations may be oriented, and the composite fibrous web has a thickness and exhibits a Solidity of less than 10%.

Oriented fibers are fibers where there is molecular orientation within the fiber. Fully oriented and partially oriented polymeric fibers are known and commercially available. Orientation of fibers can be measured in a number of ways, including birefringence, heat shrinkage, X-ray scattering, and elastic modulus (see e.g., *Principles of Polymer Processing*, Zehev Tadmor and Costas Gogos, John Wiley and Sons, New York, 1979, pp. 77-84). It is important to note that molecular orientation is distinct from crystallinity, as both crystalline and amorphous materials can exhibit molecular orientation independent from crystallization. Thus, even though commercially known sub-micrometer fibers made by melt-blowing or electrospinning are not oriented, there are known methods of imparting molecular orientation to fibers made using those processes. However, the process described by Torobin (see e.g., U.S. Pat. No. 4,536,361) has not been shown to produce molecularly oriented fibers.

Furthermore, it has not heretofore been known to control Solidity to less than 10% by controlling the ratio of the number of sub-micrometer fibers to the number of microfibers within a single-layer nonwoven fibrous web, or to use a support layer to provide a low Solidity multi-layer nonwoven fibrous web.

In some exemplary embodiments, a nonwoven fibrous web may be formed, comprising only a population of sub-micrometer fibers having a median diameter less than one micrometer (μm). In other exemplary embodiments, the nonwoven fibrous web further comprises a population of microfibers having a median diameter of at least 1 μm. At least one of the fiber populations may be oriented, and the nonwoven fibrous web may exhibit a Solidity of less than 10%.

For embodiments in which the nonwoven fibrous web comprises two or more distinct populations of fibers including a population of sub-micrometer fibers and a population of microfibers, the population of sub-micrometer fibers may be more concentrated proximate the centerline of the web (defined at a position of about one half of the web thickness) of the single-layer nonwoven fibrous web. In other words, the ratio of the number of sub-micrometer fibers to the number of microfibers may vary across the thickness of the nonwoven fibrous web. A concentration gradient from higher number concentration of sub-micrometer fibers to lower number concentration of sub-micrometer fibers may exist across or within the nonwoven fibrous web. In certain exemplary embodiments, the nonwoven fibrous web may comprise a multi-layer construction. One of the layers may be a support layer.

In other exemplary embodiments, the population of sub-micrometer fibers may be intermixed with the population of microfibers to form an inhomogenous mixture of fibers. The population of sub-micrometer fibers may be more concentrated proximate one or both major surfaces of the nonwoven fibrous web. A concentration gradient from higher number concentration of microfibers to lower number concentration of microfibers may exist through or within the nonwoven fibrous web.

For any of the previously described exemplary embodiments of a nonwoven fibrous web according to the present disclosure, the single-layer nonwoven fibrous web will exhibit a basis weight, which may be varied depending upon the particular end use of the web. Typically, the single-layer nonwoven fibrous web has a basis weight of less than about 1000 grams per square meter (gsm). In some embodiments, the single-layer nonwoven fibrous web has a basis weight of from about 1.0 gsm to about 500 gsm. In other embodiments, the single-layer nonwoven fibrous web has a basis weight of from about 10 gsm to about 300 gsm.

As with the basis weight, the single-layer nonwoven fibrous web will exhibit a thickness, which may be varied depending upon the particular end use of the web. Typically, the single-layer nonwoven fibrous web has a thickness of less than about 300 millimeters (mm). In some embodiments, the single-layer nonwoven fibrous web has a thickness of from about 0.5 mm to about 150 mm. In other embodiments, the single-layer nonwoven fibrous web has a thickness of from about 1.0 mm to about 50 mm.

Various components of exemplary nonwoven fibrous webs according to the present disclosure will now be described.

1. Sub-Micrometer Fiber Component

The nonwoven fibrous webs of the present disclosure comprise one or more fine sub-micrometer fiber components. In some embodiments, a preferred fine sub-micrometer fiber component is a sub-micrometer fiber component comprising fibers having a median fiber diameter of less than one micrometer (μm). In some exemplary embodiments, the sub-micrometer fiber component comprises fibers have a median fiber diameter ranging from about 0.2 μm to about 0.9 μm. In other exemplary embodiments, the sub-micrometer fiber component comprises fibers have a median fiber diameter ranging from about 0.5 μm to about 0.7 μm.

In the present disclosure, the "median fiber diameter" of fibers in a given sub-micrometer fiber component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 200.

In some exemplary embodiments, the sub-micrometer fiber component may comprise one or more polymeric materials. Suitable polymeric materials include, but are not limited to, polyolefins such as polypropylene and polyethylene; polyesters such as polyethylene terephthalate and polybutylene terephthalate; polyamide (Nylon-6 and Nylon-6,6); polyurethanes; polybutene; polylactic acids; polyvinyl alcohol; polyphenylene sulfide; polysulfone; liquid crystalline polymers; polyethylene-co-vinylacetate; polyacrylonitrile; cyclic polyolefins; polyoxymethylene; polyolefinic thermoplastic elastomers; or a combination thereof.

The sub-micrometer fiber component may comprise monocomponent fibers comprising any one of the above-mentioned polymers or copolymers. In this exemplary embodiment, the monocomponent fibers may contain additives as described below, but comprise a single fiber-forming material selected from the above-described polymeric materials. Further, in this exemplary embodiment, the monocomponent fibers typically comprise at least 75 weight percent of any one of the above-described polymeric materials with up to 25 weight percent of one or more additives. Desirably, the monocomponent fibers comprise at least 80 weight percent, more desirably at least 85 weight percent, at least 90 weight percent, at least 95 weight percent, and as much as 100 weight percent of any one of the above-described polymeric materials, wherein all weights are based on a total weight of the fiber.

The sub-micrometer fiber component may also comprise multi-component fibers formed from (1) two or more of the above-described polymeric materials and (2) one or more additives as described below. As used herein, the term "multi-component fiber" is used to refer to a fiber formed from two or more polymeric materials. Suitable multi-component fiber configurations include, but are not limited to, a sheath-core configuration, a side-by-side configuration, and an "islands-in-the-sea" configuration (for example, fibers produced by Kuraray Company, Ltd., Okayama, Japan).

For sub-micrometer fiber components formed from multi-component fibers, desirably the multi-component fiber comprises (1) from about 75 to about 99 weight percent of two or more of the above-described polymers and (2) from about 25 to about 1 weight percent of one or more additional fiber-forming materials based on the total weight of the fiber.

2. Optional Microfiber Component

The nonwoven fibrous webs of the present disclosure optionally comprise one or more coarse fiber components such as a microfiber component. In some embodiments, a preferred coarse fiber component is a microfiber component comprising fibers having a median fiber diameter of at least 1 μm. In some exemplary embodiments, the microfiber component comprises fibers have a median fiber diameter ranging from about 2 μm to about 100 μm. In other exemplary embodiments, the microfiber component comprises fibers have a median fiber diameter ranging from about 5 μm to about 50 μm.

In the present disclosure, the "median fiber diameter" of fibers in a given microfiber component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 200.

In some exemplary embodiments, the microfiber component may comprise one or more polymeric materials. Generally, any fiber-forming polymeric material may be used in preparing the microfiber, though usually and preferably the fiber-forming material is semi-crystalline. The polymers commonly used in fiber formation, such as polyethylene, polypropylene, polyethylene terephthalate, nylon, and urethanes, are especially useful. Webs have also been prepared from amorphous polymers such as polystyrene. The specific polymers listed here are examples only, and a wide variety of other polymeric or fiber-forming materials are useful.

Suitable polymeric materials include, but are not limited to, polyolefins such as polypropylene and polyethylene; polyesters such as polyethylene terephthalate and polybutylene terephthalate; polyamide (Nylon-6 and Nylon-6,6); polyurethanes; polybutene; polylactic acids; polyvinyl alcohol; polyphenylene sulfide; polysulfone; liquid crystalline polymers; polyethylene-co-vinylacetate; polyacrylonitrile; cyclic polyolefins; polyoxymethylene; polyolefinic thermoplastic elastomers; or a combination thereof.

A variety of natural fiber-forming materials may also be made into nonwoven microfibers according to exemplary embodiments of the present disclosure. Preferred natural materials may include bitumen or pitch (e.g., for making carbon fibers). The fiber-forming material can be in molten form or carried in a suitable solvent. Reactive monomers can also be employed, and reacted with one another as they pass to or through the die. The nonwoven webs may contain a mixture of fibers in a single layer (made for example, using two closely spaced die cavities sharing a common die tip), a plurality of layers (made for example, using a plurality of die cavities arranged in a stack), or one or more layers of multi-component fibers (such as those described in U.S. Pat. No. 6,057,256 to Krueger et al.).

Fibers also may be formed from blends of materials, including materials into which certain additives have been blended, such as pigments or dyes. Bi-component microfibers, such as core-sheath or side-by-side bi-component fibers, may be prepared ("bi-component" herein includes fibers with two or more components, each component occupying a part of the cross-sectional area of the fiber and extending over a substantial length of the fiber), as may be bicomponent sub-micrometer fibers. However, exemplary embodiments of the disclosure may be particularly useful and advantageous with monocomponent fibers (in which the fibers have essentially the same composition across their cross-section, but "monocomponent" includes blends or additive-containing materials, in which a continuous phase of substantially uniform composition extends across the cross-section and over the length of the fiber). Among other benefits, the ability to use single-component fibers reduces complexity of manufacturing and places fewer limitations on use of the web.

In addition to the fiber-forming materials mentioned above, various additives may be added to the fiber melt and extruded to incorporate the additive into the fiber. Typically, the amount of additives is less than about 25 wt %, desirably, up to about 5.0 wt %, based on a total weight of the fiber. Suitable additives include, but are not limited to, particulates, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, fire retardants, and fluorochemicals.

One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

3. Optional Support Layer

The nonwoven fibrous webs of the present disclosure may further comprise a support layer such as support layer of exemplary multi-layer composite nonwoven fibrous article shown in FIG. 1*d* of copending PCT International Pub. No. WO 09/085,769. When present, the support layer may provide most of the strength of the composite nonwoven fibrous article. In some embodiments, the above-described sub-micrometer fiber component tends to have very low strength, and can be damaged during normal handling. Attachment of the sub-micrometer fiber component to a support layer lends strength to the sub-micrometer fiber component, while retaining the low Solidity and hence the desired properties of the sub-micrometer fiber component. A multi-layer nonwoven fibrous web structure may also provide sufficient strength for further processing, which may include, but is not limited to, winding the web into roll form, removing the web from a roll, molding, pleating, folding, stapling, weaving, and the like.

A variety of support layers may be used in the present disclosure. Suitable support layers include, but are not limited to, a nonwoven fabric, a woven fabric, a knitted fabric, a foam layer, a film, a paper layer, an adhesive-backed layer, a foil, a mesh, an elastic fabric (i.e., any of the above-described woven, knitted or nonwoven fabrics having elastic properties), an apertured web, an adhesive-backed layer, or any combination thereof. In one exemplary embodiment, the support layer comprises a polymeric nonwoven fabric. Suitable nonwoven polymeric fabrics include, but are not limited to, a spunbonded fabric, a meltblown fabric, a carded web of staple length fibers (i.e., fibers having a fiber length of less than about 100 mm), a needle-punched fabric, a split film web, a hydroentangled web, an airlaid staple fiber web, or a combination thereof. In certain exemplary embodiments, the support layer comprises a web of bonded staple fibers. As described further below, bonding may be effected using, for example, thermal bonding, adhesive bonding, powdered binder bonding, hydroentangling, needlepunching, calendering, or a combination thereof.

The support layer may have a basis weight and thickness depending upon the particular end use of the composite nonwoven fibrous article. In some embodiments of the present disclosure, it is desirable for the overall basis weight and/or thickness of the composite nonwoven fibrous article to be kept at a minimum level. In other embodiments, an overall minimum basis weight and/or thickness may be required for a given application. Typically, the support layer has a basis weight of less than about 150 grams per square meter (gsm). In some embodiments, the support layer has a basis weight of from about 5.0 gsm to about 100 gsm. In other embodiments, the support layer has a basis weight of from about 10 gsm to about 75 gsm.

As with the basis weight, the support layer may have a thickness, which varies depending upon the particular end use of the composite nonwoven fibrous article. Typically, the support layer has a thickness of less than about 150 millimeters (mm). In some embodiments, the support layer has a thickness of from about 0.05 mm to about 35 mm, more preferably 1.0 mm to about 35 mm. In other embodiments, the support layer has a thickness of from about 1.0 mm to about 25 mm, more preferably about 2.0 to about 25 mm.

In certain exemplary embodiments, the support layer may comprise a microfiber component, for example, a plurality of microfibers. In such embodiments, it may be preferred to deposit the above-described sub-micrometer fiber population directly onto the microfiber support layer to form a multi-layer nonwoven fibrous web. Optionally, the above-described microfiber population may deposited with or over the sub-micrometer fiber population on the microfiber support layer. In certain exemplary embodiments, the plurality of microfibers comprising the support layer are compositionally the same as the population of microfibers forming the overlayer.

The sub-micrometer fiber component may be permanently or temporarily bonded to a given support layer. In some embodiments of the present disclosure, the sub-micrometer fiber component is permanently bonded to the support layer (i.e., the sub-micrometer fiber component is attached to the support layer with the intention of being permanently bonded thereto).

In some embodiments of the present disclosure, the above-described sub-micrometer fiber component may be temporarily bonded to (i.e., removable from) a support layer, such as a release liner. In such embodiments, the sub-micrometer fiber component may be supported for a desired length of time on a temporary support layer, and optionally further processed on a temporary support layer, and subsequently permanently bonded to a second support layer.

In one exemplary embodiment of the present disclosure, the support layer comprises a spunbonded fabric comprising polypropylene fibers. In a further exemplary embodiment of the present disclosure, the support layer comprises a carded web of staple length fibers, wherein the staple length fibers comprise: (i) low-melting point or binder fibers; and (ii) high-melting point or structural fibers. Typically, the binder fibers have a melting point of at least 10° C. less than a melting point of the structural fibers, although the difference between the melting point of the binder fibers and structural fibers may be greater than 10° C. Suitable binder fibers include, but are not limited to, any of the above-mentioned polymeric fibers. Suitable structural fibers include, but are not limited to, any of the above-mentioned polymeric fibers, as well as inorganic fibers such as ceramic fibers, glass fibers, and metal fibers; and organic fibers such as cellulosic fibers.

In certain presently preferred embodiments, the support layer comprises a carded web of staple length fibers, wherein the staple length fibers comprise a blend of PET monocomponent, and PET/coPET bicomponent staple fibers. In one exemplary presently preferred embodiment, the support layer comprises a carded web of staple length fibers, wherein the staple length fibers comprise: (i) about 20 wt % bicomponent binder fibers (Invista T254 fibers commercially available from Invista, Inc. (Wichita, Kans.)) (12d×1.5"); and (ii) about 80 wt % structural fibers (Invista T293 PET fibers (32d×3").

As described above, the support layer may comprise one or more layers in combination with one another. In one exemplary embodiment, the support layer comprises a first layer, such as a nonwoven fabric or a film, and an adhesive layer on the first layer opposite the sub-micrometer fiber component. In this embodiment, the adhesive layer may cover a portion of or the entire outer surface of the first layer. The adhesive may comprise any known adhesive including pressure-sensitive adhesives, heat activatable adhesives, etc. When the adhesive layer comprises a pressure-sensitive adhesive, the composite nonwoven fibrous article may further comprise a release liner to provide temporary protection of the pressure-sensitive adhesive.

4. Optional Additional Layers

The nonwoven fibrous webs of the present disclosure may comprise additional layers in combination with the sub-micrometer fiber component, the support layer, or both. One or more additional layers may be present over or under an outer surface of the sub-micrometer fiber component, under an outer surface of the support layer, or both.

Suitable additional layers include, but are not limited to, a color-containing layer (e.g., a print layer); any of the above-described support layers; one or more additional sub-micrometer fiber components having a distinct average fiber diameter and/or physical composition; one or more secondary fine sub-micrometer fiber layers for additional insulation performance (such as a melt-blown web or a fiberglass fabric); foams; layers of particles; foil layers; films; decorative fabric layers; membranes (i.e., films with controlled permeability, such as dialysis membranes, reverse osmosis membranes, etc.); netting; mesh; wiring and tubing networks (i.e., layers of wires for conveying electricity or groups of tubes/pipes for conveying various fluids, such as wiring networks for heating blankets, and tubing networks for coolant flow through cooling blankets); or a combination thereof.

5. Optional Attachment Devices

In certain exemplary embodiments, the nonwoven fibrous webs of the present disclosure may further comprise one or more attachment devices to enable the composite nonwoven fibrous article to be attached to a substrate. As discussed above, an adhesive may be used to attach the composite nonwoven fibrous article. In addition to adhesives, other attachment devices may be used. Suitable attachment devices include, but are not limited to, any mechanical fastener such as screws, nails, clips, staples, stitching, thread, hook and loop materials, etc.

The one or more attachment devices may be used to attach the composite nonwoven fibrous article to a variety of substrates. Exemplary substrates include, but are not limited to, a vehicle component; an interior of a vehicle (i.e., the passenger compartment, the motor compartment, the trunk, etc.); a wall of a building (i.e., interior wall surface or exterior wall surface); a ceiling of a building (i.e., interior ceiling surface or exterior ceiling surface); a building material for forming a wall or ceiling of a building (e.g., a ceiling tile, wood component, gypsum board, etc.); a room partition; a metal sheet; a glass substrate; a door; a window; a machinery component; an appliance component (i.e., interior appliance surface or exterior appliance surface); a surface of a pipe or hose; a computer or electronic component; a sound recording or reproduction device; a housing or case for an appliance, computer, etc.

E. Methods of Using Nonwoven Fibrous Webs

The present disclosure is directed to nonwoven fibrous webs that may be advantageous for absorbent articles useful, for example, as absorbent wipes for surface cleaning, as gas and liquid absorbent or filtration media, and as barrier materials for sound absorption. Exemplary embodiments of the nonwoven fibrous webs may have structural features that enable their use in a variety of applications, have exceptional absorbent properties, exhibit high porosity and permeability due to their low Solidity, and/or be manufactured in a cost-effective manner. Resiliency or collapse (e.g., crush) resistance is a desirable feature of exemplary preferred embodiments of the present disclosure.

Thus, in certain embodiments, the present disclosure is also directed to methods of using the nonwoven fibrous webs of the present disclosure in a variety of absorption applications. In a further aspect, the disclosure relates to an article comprising a nonwoven fibrous web including a population of sub-micrometer fibers having a median diameter less than one micrometer (μm), and a population of microfibers having a median diameter of at least 1 μm, wherein at least, one of the fiber populations is oriented, and the nonwoven fibrous web has a thickness and exhibits a Solidity of less than 10%. In exemplary embodiments, the article may be used as a gas filtration article, a liquid filtration article, a sound absorption article, a surface cleaning article, a cellular growth support article, a drug delivery article, a personal hygiene article, or a wound dressing article.

For example, a low Solidity sub-micrometer nonwoven fibrous web of the present disclosure may be advantageous in gas filtration applications due to the reduced pressure drop that results from lower Solidity. Decreasing the Solidity of a sub-micrometer fiber web will generally reduce its pressure drop. Lower pressure drop increase upon particulate loading of low Solidity sub-micrometer nonwoven fibrous web of the present disclosure may also result. Current technology for forming particle-loaded sub-micrometer fibers results in much higher pressure drop than for coarser microfiber webs, partially due to the higher Solidity of the fine sub-micrometer fiber web.

In addition, the use of sub-micrometer fibers in gas filtration may be particularly advantageous due to the improved particle capture efficiency that sub-micrometer fibers may provide. In particular, sub-micrometer fibers may capture small diameter airborne particulates better than coarser fibers. For example, sub-micrometer fibers may more efficiently capture airborne particulates having a dimension smaller than about 1000 nanometers (nm), more preferably smaller than about 500 nm, even more preferably smaller than about 100 nm, and most preferably below about 50 nm. Gas filters such as this may be particularly useful in personal protection respirators; heating, ventilation and air conditioning (HVAC) filters; automotive air filters (e.g., automotive engine air cleaners, automotive exhaust gas filtration, automotive passenger compartment air filtration); and other gas-particulate filtration applications.

Liquid filters containing sub-micrometer fibers with low Solidity in the form of nonwoven fibrous webs of the present disclosure may also have the advantage of improved depth loading while maintaining small pore size for capture of sub-micrometer, liquid-borne particulates. These properties improve the loading performance of the filter by allowing the filter to capture more of the challenge particulates without plugging.

A low Solidity sub-micrometer fiber-containing nonwoven fibrous web of the present disclosure may also be a preferred substrate for supporting a membrane. The low Solidity fine web could act a both a physical support for the membrane, but also as a depth pre-filter, enhancing the life of the membrane. The use of such a system could act as a highly effective symmetric or asymmetric membrane. Applications for such membranes include ion-rejection, ultrafiltration, reverse osmosis, selective binding and/or adsorption, and fuel cell transport and reaction systems.

Low Solidity sub-micrometer nonwoven fibrous webs of the present disclosure may also be useful synthetic matrices for promoting cellular growth. The open structure with fine sub-micrometer fibers may mimic naturally occurring systems and promotes more in vivo-like behavior. This is in contrast to current products (such as Donaldson ULTRA-WEB™ Synthetic ECM, available from Donaldson Corp., Minneapolis, Minn.) where high Solidity fiber webs act as a synthetic support membrane, with little or no penetration of cells within the fiber matrix.

The structure provided by the nonwoven fibrous webs of the present disclosure may also be an effective wipe for surface cleaning, where the fine sub-micrometer fibers form a soft wipe, while low Solidity has the advantage of providing a reservoir for cleaning agents and high pore volume for trapping debris.

In one particular exemplary embodiment, the method of using a composite nonwoven fibrous article comprises a method of absorbing sound in an area, wherein the method comprises the steps of surrounding at least a portion of the area with a sub-micrometer fiber component, wherein the sub-micrometer fiber component comprising fibers having a median fiber diameter of less than 1 μm.

For acoustic and thermal insulation applications, providing the fine sub-micrometer fibers in a low Solidity form improves acoustic absorbance by exposing more of the surface area of the sub-micrometer fibers, as well as specifically improving low frequency acoustic absorbance by allowing for a thicker web for a given basis weight. In thermal insulation applications in particular, a low Solidity fine sub-micrometer fiber insulation containing sub-micrometer fibers would have a soft feel and high drapability, while providing a very low Solidity web for trapping insulating air. In some embodiments of an acoustic and/or thermal insulation article, an entire area may be surrounded by a nonwoven fibrous web including a sub-micrometer fiber component, provided alone or on a support layer. The support structure and the fine sub-micrometer fiber population(s) need not be homogeneously dispersed within one another. There may be advantages in cushioning, resiliency and filter loading for asymmetric loading to provide ranges of pore sizes, higher density regions, exterior skins or flow channels.

Exemplary embodiments of nonwoven fibrous webs including chemically active particulates of the present disclosure have been described above and are further illustrated below by way of the following Examples, which are not to be construed in any way as imposing limitations upon the scope of the present invention. On the contrary, it is to be clearly understood that resort may be had to various other embodiments, modifications, and equivalents thereof which, after reading the description herein, may suggest themselves to those skilled in the art without departing from the spirit of the present disclosure and/or the scope of the appended claims.

EXAMPLES

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Example 1

A single nozzle die was constructed to make nanofibers. The die consisted of a single circular fiber forming orifice with an adjustable central air jet, as shown in FIG. 2. The jet and film profiles were set using the dimensions of the central air nozzle, which was located co-axially with the center of the film forming orifice. The outer diameter of the film orifice was 0.203 inches. The outer diameter of the air jet nozzle, which also acted as the inner diameter of the film orifice, was 0.200 inches. The outside surface of the air jet nozzle was tapered inward at a 45 degree angle at the exit end of the nozzle to a final outer diameter of 0.120 inches. The inner surface of the air jet nozzle was a converging orifice. The terminal end of the air jet was a 30 degree taper to a final inner diameter of 0.100 inches. The nozzle was adjusted such that the terminal end of the air jet nozzle extended from the die face by 0.030 inches.

The die was electrically heated and supplied air and polymer using stainless steel tubing. The die was supplied with molten polymer from a ¾" single screw extruder. The polymer used was grade 3960 polypropylene from Total Petrochemicals (Houston, Tex.). Air was supplied to the die from house air compressors using a pressure regulator to control air flow.

The die temperature was set at 330° C. The air pressure was set at 20 psi and at ambient temperature. The polymer flow rate was 1 pound per hour. A sample of the fiber produced was collected below the nozzle using a hand held screen and measured using scanning electron microscopy. A total of 187 fibers from the sample were measured using the electron micrographs. The mean diameter was found to be 0.755 μm, and the median diameter was found to be 0.578 μm.

Example 2

The same die as Example 1 was fitted with an alternative air nozzle design as shown in FIG. 3. The air nozzle in this case had an irregular tip comprising a plurality or series of pointed teeth along the edge of the air nozzle. The air jet nozzle had an outer diameter of 0.198 inches. At the end of the nozzle there was a series of symmetric triangular cuts forming a 'saw-tooth' or serrated edge comprising a plurality of teeth, thereby creating a saw-toothed pattern around the perimeter of the nozzle end. A total of 20 triangular teeth were evenly spaced around the circumference of the nozzle end. The included angle of the cuts was 30 degrees and the cuts were spaced as to make the pattern continuous with no remaining unprofiled edge. The inside of the jet nozzle was tapered outwards at a 12 degree angle in such a way as to make the end of the nozzle tips as sharp as possible. Prior to the inside jet nozzle taper, the diameter was 0.120 inches. The die was adjusted so that the bases of the triangular cuts were even with die face and the tips were extended out beyond the die face.

The same extrusion system was used as in Example 1. The die temperature was 340° C. The polymer used was grade MF650Y polypropylene from LyondellBasell (Rotterdam, Netherlands). Air was supplied at 70 psi pressure and ambient temperature. A sample of the fiber produced was collected using a hand held screen and measured using scanning electron microscopy. A total of 153 fibers were measured using electron micrographs. The mean diameter was 0.842 μm, and the median diameter was 0.803 μm.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the present invention. Thus, the appearances of the phrases such as "in one or more embodiments," "in certain embodiments," "in one embodiment" or "in an embodiment" in various places throughout this specification are not necessarily referring to the same embodiment of the present invention. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Furthermore, all publications, published patent applications and issued patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A nozzle, comprising:

a first conduit having a first terminal end;

a second conduit positioned coaxially around the first conduit and having a second terminal end proximate the first terminal end; and a nit liner positioned between at least a portion of the first conduit and the second conduit, wherein the nit liner permits axial adjustment of a distance between the first terminal end and the second terminal end, further wherein said first and second conduit form an annular channel between said first and second conduit configured to pass a molten polymer through the annular channel, and additionally, wherein the first terminal end extends axially outwardly beyond the second terminal end, and is positioned to pass a pressurized gas out of said nozzle at a position beyond said second terminal end.

2. The nozzle of claim 1, wherein at least a portion of the annular channel proximate the first terminal end is directed towards the first conduit.

3. The nozzle of claim 1, wherein the first terminal end is defined by a generally circular perimeter.

4. The nozzle of claim 3, wherein the generally circular perimeter comprises a serrated edge comprising a plurality of teeth creating a saw-toothed pattern around the perimeter.

5. The nozzle of claim 1, wherein the first terminal end extends axially outwardly beyond the second terminal end by at least 0.1 mm.

6. The nozzle of claim 5, wherein the first terminal end extends axially outwardly beyond the second terminal end by at most 5 mm.

7. A die comprising at least one nozzle, the at least one nozzle comprising:

a first conduit having a first terminal end;

a second conduit positioned coaxially around the first conduit and having a second terminal end proximate the first terminal end, and a nit liner positioned between at least a portion of the first conduit and the second conduit, wherein the nit liner permits axial adjustment of a distance between the first terminal end and the second terminal end, further wherein said first and second conduit form an annular channel between said first and second conduit, and configured to pass a molten polymer through the annular channel, and additionally, wherein the first terminal end extends axially outwardly beyond the second terminal end, and is positioned to pass a pressurized gas out of said nozzle at a position beyond said second terminal end.

8. The die of claim 7 comprising a plurality of said at least one nozzles.

9. The die of claim 8, wherein the plurality of said nozzles is arranged in a plurality of rows, such that a fiber stream emitted from any row of nozzles does not substantially overlap in flight with a fiber stream emitted from any other row of nozzles.

10. An apparatus for forming a nonwoven fibrous web, comprising:

a source of molten polymer;

a source of pressurized gas;

a die comprising at least one nozzle, the at least one nozzle comprising:

a first conduit having a first terminal end;

a second conduit positioned coaxially around the first conduit and having a second terminal end proximate the first terminal end, and a nit liner positioned between at least a portion of the first conduit and the second conduit, wherein the nit liner permits axial adjustment of a distance between the first terminal end and the second terminal end, further wherein said first and second conduit form an annular channel between said first and second conduit, wherein the first terminal end extends axially outwardly beyond the second terminal end, and additionally wherein said annular channel is connected to said source of molten polymer, and said first conduit is connected to the source of pressurized gas; and a collector for collecting said fluent material after exiting the die, wherein said fluent material is collected in substantially solid form as a nonwoven fibrous web on the collector.

11. A system for forming a plurality of sub-micrometer fibers, comprising:

a molten polymer stream;

a pressurized gas stream;

a die comprising at least one nozzle, the at least one nozzle comprising:

a first conduit having a first terminal end;

a second conduit positioned coaxially around the first conduit and having a second terminal end proximate the first terminal end, and a nit liner positioned between at least a portion of the first conduit and the second conduit, wherein the nit liner permits axial adjustment of a distance between the first terminal end and the second terminal end, further wherein said first and second conduit form an annular channel between said first and second conduit configured to pass the molten polymer stream through the annular channel, additionally wherein the first terminal end extends axially outwardly beyond the second terminal end, and said first conduit is in flow communication with said pressurized gas stream; and optionally, a collector for collecting said fluent material as a plurality of nonwoven fibers after exiting the die, wherein said plurality of fibers is collected in substantially solid form on the collector as a nonwoven fibrous web.

12. The system of claim 11, wherein the molten polymer stream comprises polypropylene, polyethylene, polyester, polyethylene terephthalate, polybutylene terephthalate, polyamide, polyurethane, polybutene, polylactic acid, polyvinyl alcohol, polyphenylene sulfide, polysulfone, liquid crystalline polymer, polyethylene-co-vinylacetate, polyacrylonitrile, cyclic polyolefin, polyoxymethylene, polyolefinic thermoplastic elastomers, or a combination thereof.

13. The system of claim 11, wherein the pressurized gas stream comprises compressed air.

14. A method of making a nonwoven fibrous web, comprising:

providing a source of a molten polymer;

providing a pressurized gas stream;

providing a die comprising at least one nozzle, the at least one nozzle comprising:

a first conduit having a first terminal end;

a second conduit positioned coaxially around the first conduit and having a second terminal end proximate the first terminal end; and a nit liner positioned between at least a portion of the first conduit and the second conduit, wherein the nit liner permits axial adjustment of a distance between the first terminal end and the second terminal end, further wherein said first and second conduit form an annular channel between said first and second conduit, and additionally, wherein the first terminal end extends axially outwardly beyond the second terminal end;

placing said annular channel in flow communication with said source of molten polymer;

placing said first conduit in flow communication with said pressurized gas stream; and collecting said molten polymer after exiting the die as a plurality of nonwoven fibers, wherein said plurality of fibers is collected in substantially solid form as a nonwoven fibrous web.

15. A method of making a nonwoven fibrous web, comprising:

a. forming a population of sub-micrometer fibers having a median fiber diameter of less than one micrometer (μm), using a die comprising at least one nozzle, the at least one nozzle comprising:

a first conduit having a first terminal end;

a second conduit positioned coaxially around the first conduit and having a second terminal end positioned to pass a pressurized gas proximate the first terminal end; and a nit liner positioned between at least a portion of the first conduit and the second conduit, wherein the nit liner permits axial adjustment of a distance between the first terminal end and the second terminal end, further wherein said first and second conduit form an annular channel between said first and second conduit configured to pass a molten polymer through the annular channel;

additionally wherein the first terminal end extends axially outwardly beyond the second terminal end, and is positioned to pass a pressurized gas out of said first;

b. forming a population of microfibers having a median fiber diameter of at least 1 μm; and c. combining the population of sub-micrometer fibers and the population of microfibers into a nonwoven fibrous web, wherein at least one of the fiber populations includes substantially oriented fibers, and further wherein the nonwoven fibrous web has a thickness and exhibits a Solidity of less than 10%.

16. The method of claim 15, wherein the population of sub-micrometer fibers has a median fiber diameter ranging from about 0.1 μm to about 0.9 μm.

17. The method of claim 15, wherein the population of microfibers has a median fiber diameter ranging from about 1 μm to about 50 μm.

18. The method of claim 15, wherein the population of microfibers comprises polymeric fibers.

19. The method of claim 15, wherein the population of sub-micrometer fibers is combined with the population of microfibers to form an inhomogenous mixture of fibers, wherein a ratio of the number of sub-micrometer fibers to the number of microfibers varies across the thickness of the nonwoven fibrous web.

20. An article comprising the nonwoven fibrous web prepared according to the method of claim 15, selected from the group consisting of a gas filtration article, a liquid filtration article, a sound absorption article, a surface cleaning article, a cellular growth support article, a drug delivery article, a personal hygiene article, and a wound dressing article.

* * * * *